US005390374A

United States Patent [19]

Hubrig et al.

[11] Patent Number: 5,390,374

[45] Date of Patent: Feb. 21, 1995

[54] WATER-CONSERVING URINAL

[76] Inventors: Sylvan E. Hubrig, 10734 Hutton Dr., Sun City, Ariz. 85351; Donald K. Lachowitzer, 356 7th Ave. South, Fargo, N. Dak. 58103

[21] Appl. No.: 78,634

[22] Filed: Jun. 21, 1993

[51] Int. Cl.[6] ..... E03D 13/00

[52] U.S. Cl. ..... 4/301; 4/341; 4/300.1; 4/342

[58] Field of Search ..... 4/342, 340, 341, 301, 4/302, 303, 309, 310, 311, 144.2, 144.3, 144.4, 144.1, 260, 262, 266, 300.1; 208/75, 94; 140/337, 340

[56] References Cited

U.S. PATENT DOCUMENTS

| | | | |
|---|---|---|---|
| 487,130 | 11/1892 | Schoen | 4/309 |
| 647,895 | 4/1900 | Burson | 4/309 |
| 2,813,631 | 11/1957 | Odman | 4/301 |
| 3,412,408 | 11/1968 | Michal, Jr. | 4/341 |
| 3,500,480 | 3/1970 | Michal, Jr. | 4/341 |
| 3,964,110 | 6/1976 | Kapit | 4/301 |
| 4,103,367 | 8/1978 | Kaufer | 4/309 |
| 4,135,261 | 1/1979 | Uhrman | 4/309 |
| 4,137,579 | 2/1979 | Soler | 4/311 |
| 4,180,875 | 1/1980 | Wilson | 4/309 |
| 4,270,231 | 6/1981 | Zint | 4/144.1 |
| 4,282,611 | 8/1981 | O'Day | 4/301 |
| 4,285,076 | 8/1981 | Dickstein | 4/341 |
| 4,450,595 | 5/1984 | Saccomanno | 4/301 |
| 4,683,598 | 8/1987 | Jones | 4/301 |
| 4,856,568 | 8/1989 | Murphy et al. | 141/340 |
| 4,982,455 | 1/1991 | Carter | 4/307 |
| 4,985,940 | 1/1991 | Jones | 4/301 |
| 5,134,728 | 8/1992 | Sturm | 4/341 |
| 5,153,947 | 10/1992 | Markles | 4/251.1 |

*Primary Examiner*—Henry J. Recla
*Assistant Examiner*—Gregory M. Vidovich
*Attorney, Agent, or Firm*—Gregory J. Nelson

[57] ABSTRACT

A water conserving urinal for male and female use attachable to a toilet. The urinal includes a urinal bowl which is supported on a flexible member secured at its lower end to a pivot member. Water is supplied to the bowl from the toilet water supply line via a flexible supply line. A flush valve is provided in the water line and distributes a low volume of water around the interior of the bowl through an interiorly extending flush ring. A waste line extends from discharge of the urinal bowl through the center of the flexible support and through the toilet bowl to the sewer. Fluid waste is thus discharged directly to the sewer line without the necessity of a full flush of the toilet resulting in substantial water savings. The pivot support and flexible support permit the urinal to be moved forward to the desired position and height to accommodate the physical requirements of the user.

11 Claims, 2 Drawing Sheets

WATER-CONSERVING URINAL

FIELD OF THE INVENTION

The present invention relates to plumbing fixtures and more particularly relates to a urinal for use by both men or we, men which urinal provides significant water savings.

BACKGROUND OF THE INVENTION

The conventional toilet when flushed discharges approximately between 1.6 and 5 gallons of water into tile toilet bowl to flush and wash the contents down the sewer. Recently, consistent with the recognition of the need for water conservation, toilets have been provided which utilize less volume of water by incorporating devices such as valves which achieve negative buoyancy and close prior to the discharge of the entire contents of the toilet tank, thus saving water. Nevertheless, even with such lower water consumption devices, the normal flush will discharge over one gallon of water per flush. While this quantity of water may be necessary for flushing some materials such as fecal matter and paper, this quantity of water is in excess of that normally required for proper flushing of urine.

Apart from the problem of water conservation, the conventional toilet design does not provide the convenience and expediency of a urinal. It is not uncommon that at public events, long lines form at the rest room, particularly women's rest rooms because women's rest rooms do not provide urinals of the type generally found in men's rest rooms.

THE PRIOR ART

The prior art discloses a number of urinal attachments for toilet bowls. For example. U.S. Pat. No. 3,412,408 discloses a bowl-like urinal adjustably positionable and attachable to the toilet. The device has a flexible, disposable drain duct which discharges into the toilet bowl. While the device shown in this patent facilitates male urination, it is not generally suitable for use by females and does not result in water savings since the contents are discharged into the toilet bowl requiring a full cycle flushing operation.

U.S. Pat. No. 4,145,768 discloses a water conserving urinal having an open top funnel which can be mounted on a wall adjacent the toilet with a flexible hose which is connectable to the U-shaped gas trap section of adjacent sink or wash basin. While the device does serve to conserve water to some extent, there are certain sanitary objections to having a urinal located adjacent a wash basin or sink. Further, the device requires special installation such as soldering and does not have a cover.

U.S. Pat. No. 4,282,611 discloses a urinal adapted for attachment to a toilet bowl which has a bracket arm connected to the toilet seat anchor bolts and which extends laterally of the toilet bowl. A swing arm is pivotally connected to the bracket arm and supports a funnel. In the use-position, the funnel and stem are in registry with the toilet bowl and in a non-use position they are pivoted or swung out of registry. Again, the device while providing the convenience of a urinal, does not result in water savings and would also have certain sanitary objections in that in the non-use position, urine not drained from the device could easily drip onto the floor, wall or toilet.

U.S. Pat. No. 4,985,940 shows a plumbing fixture for installation in women's rest rooms. An elongate, flexible hose has a funnel at its top and communicates with a water-holding bowl that is flushed by a siphoning action. A sanitary cuff extends around the rim of the funnel so that the funnel does not contact the user. The cuff is removed from the funnel after use by an ejector arm when the funnel is placed between the arms of a hanger member. The urinal device of the '940 patent requires special plumbing fixtures.

U.S. Pat. No. 5,153,947 shows a urinal attachment for a floor-mounted toilet. The urinal has a bowl adjacent the toilet and the outlet of the bowl connects to a drain line fitting which attaches to tile toilet base. The drain line of the urinal bowl is connected to the drain tilting so that it bypasses the toilet bowl and yet is periodically rinsed by a water line. Again, this device requires special plumbing adaptation and could result in noxious odors from the drain pipe being communicated to the rest room via the device.

Therefore, while the above devices and others found in the prior art do to some extent provide the convenience of a urinal and also in some cases provide water saving features, there nevertheless exists a need for an improved urinal which results in water savings and which is adaptable for use by both men and women.

SUMMARY OF THE INVENTION

Accordingly, it is a broad object of the present invention to provide a water-conserving urinal assembly which is convenient to use by either men or women.

It is another object of the present invention to provide a urinal which may be conveniently mounted to existing toilet bowls.

Another object of the present invention is to provide a urinal which can be used in either private residential or public rest rooms.

It is another primary object of the present invention is to provide a urinal which use results in substantial savings of water.

Another object of the present invention is to provide a urinal which is flexibly and pivotally mounted to the toilet so as to provide convenience of use and permits the device to be moved to a convenient out-of-the-way position.

Another object of the present invention is to provide a urinal which may be plumbed to a conventional toilet and which discharges waste directly into the sewer through the toilet establishing a water seal through the toilet bowl.

Another object of the present invention is to provide a urinal having a disposable sanitary cover.

Briefly, in accordance with a preferred embodiment of the present invention, the urinal includes a funnel-shaped bowl having a cover which is hinged to close when the device is not in use. The bowl is supported on a vertical, flexible support member which at its lower end is pivotally mounted to the toilet bowl at the bolt holes at the rear of the toilet lid. A flush ring in the bowl distributes water around the upper, interior area of the tunnel and is connected by a flexible water line to the water line communicating with the toilet tank. A flexible waste or drain line extends from the bowl, through the toilet bowl and into the waste or sewer line and accordingly drains directly into the sewer when flushed without the necessity of flushing tile toilet. This arrangement also provides a water seal to prevent sewer gases and odors from being released through the urinal waste line.

The bowl is attached at tile upper end of a support member which comprises a spring which encloses the drain line and allows the bowl to be moved forward to the proper height for comfortable urination. When urination is completed, the support member will return the urinal bowl to the storage position adjacent the toilet tank. The pivotal mounting at the lower end of the flexible support also allows the device to be moved forwardly as well as flexed at the support. A universal joint may be provided at the bottom connection of the bowl to the waste line.

In another embodiment, the urinal bowl is a narrow, elongated trough which may be used both by men and women. Sanitary covers may be provided which may be placed over the top of the bowl and around the edges so the user's body does not come into contact with the urinal. The cover may then be disposed of after use in a separate waste container.

The device may also be installed independent of a toilet, as for example in a public rest room, and connected directly to the sewer line which installation would require less space than conventional toilets and allow more convenient, rapid use of these facilities by women.

BRIEF DESCRIPTION OF THE DRAWINGS

The above and other objects and advantages of the present invention will become more apparent from the following description, claims and drawings in which:

DESCRIPTION OF THE PREFERRED EMBODIMENT

Figure 1:
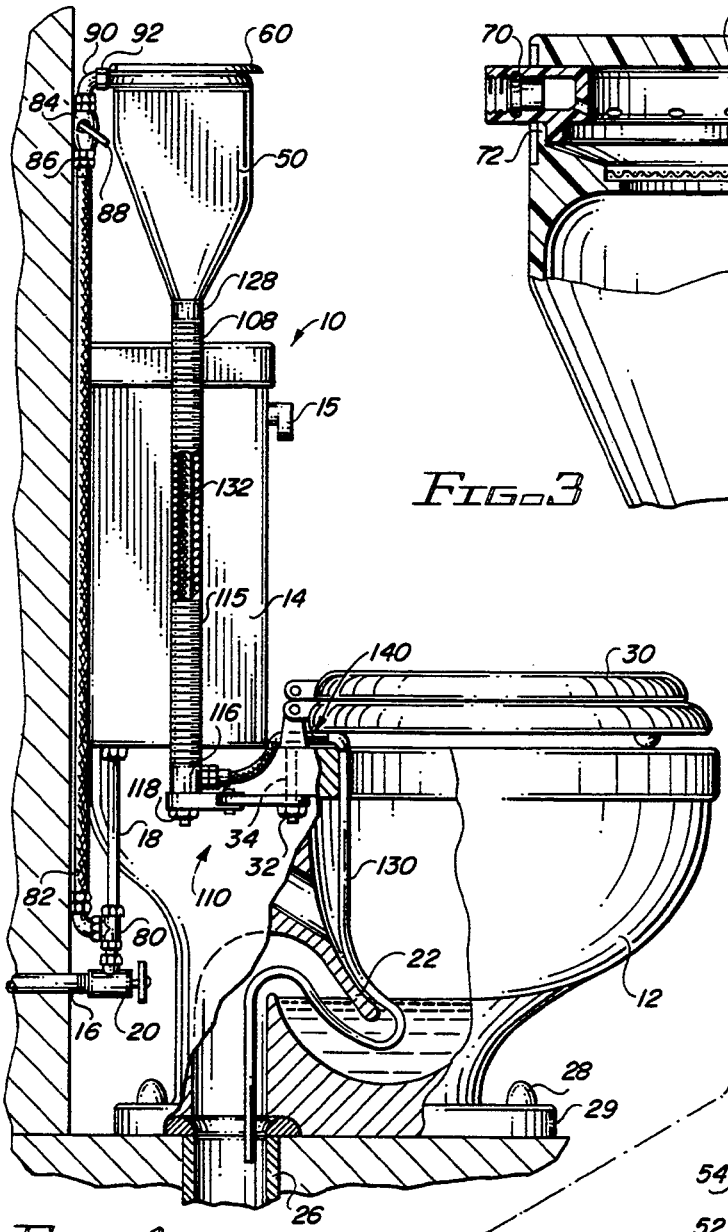
FIG. 1 is a side view, partly cut away, showing a preferred form of the urinal of the present invention attached to a conventional toilet.

Turning now to the drawings, FIGS. 1 to 4 shows a preferred form of the present invention which is generally designated by the numeral 10 and is shown in conjunction with a conventional toilet which has a toilet bowl 12 and a tank 14. The toilet tank 14 is supplied with water by means of water line 16 and filler line 18. A conventional shut-off valve 20 is provided in the water line 16. The water in tank 14 may be selectively discharged into the toilet bowl by operation of a trip handle 15 which will lift a ball or other valve member from the valve seat allowing the water from the tank to be discharged into the toilet bowl and ultimately across the trap section 22 of the toilet into the sewer line 26. The toilet is typically secured to the floor by a plurality of hold-down nuts 28 provided in the flange 29 at the base of the toilet. The toilet tank and bowl are typically ceramic and a lid assembly 30 is secured to the toilet bowl by bolts 32 which extend through bores 34 provided at the rear of the toilet bowl. The above construction is conventional and is described to facilitate an understanding of the present invention as the present invention 10 may be attached to conventional toilets of the type described.

Figure 3:
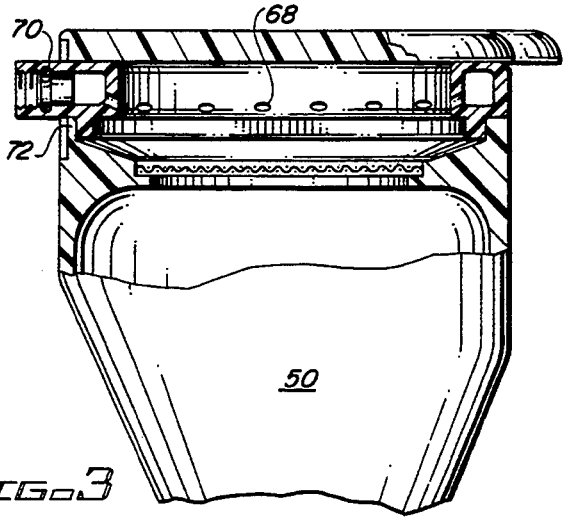
FIG. 3 is a detail view partly cut away, of a portion of the urinal bowl.
Figure 2:
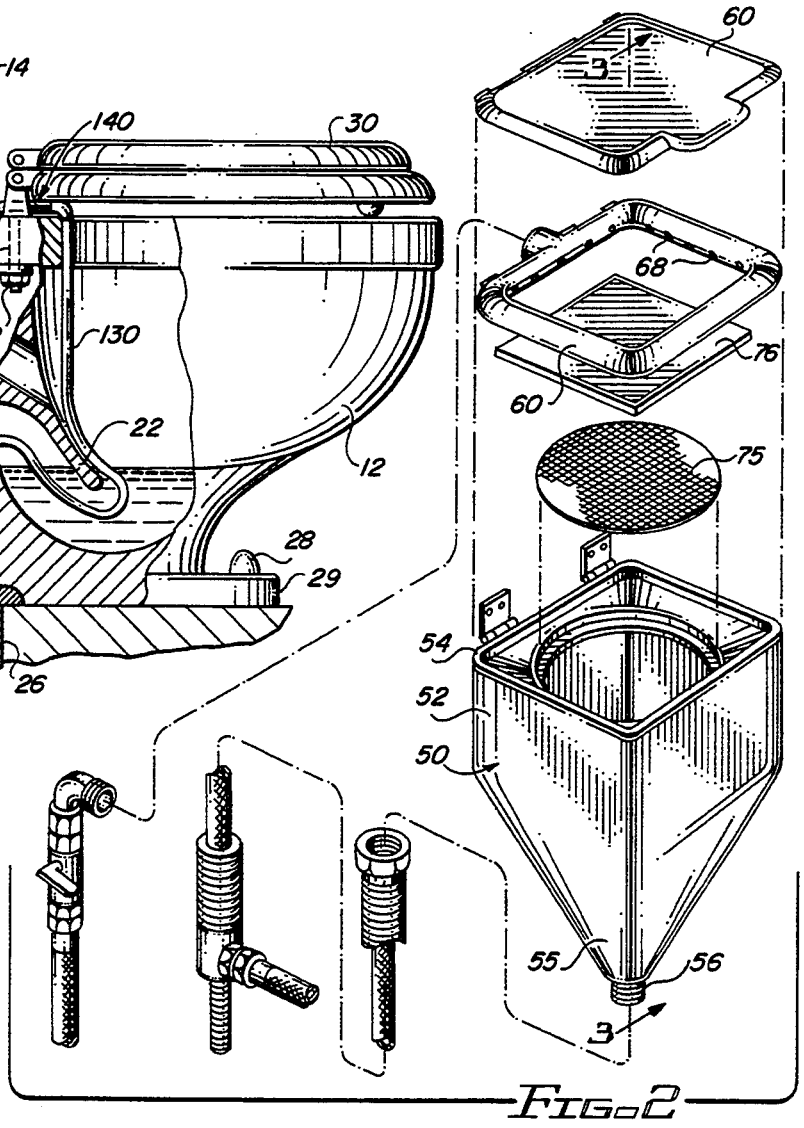
FIG. 2 is an enlarged exploded view showing the urinal bowl.

The urinal 10 includes a bowl 50 which is seen in detail in FIG. 2. The bowl is preferably molded from a suitable rigid and chemically resistant plastic material such as PVC, ABS or the like and has a side wall 52 terminating at an upper rim 54. The bowl as shown is square but may be any suitable shape such as rectangular or round. The bowl downwardly converges in a funnel portion 55 terminating at a lower outlet 56. A cover 60 is secured to the rear of the bowl by one or more hinges 62. In the open position, the cover 60 assumes a vertical or past vertical position to remain open. A flush ring 66 is shaped to conform to the shape of the interior of the bowl and is mounted at the upper edge or rim 54 as seen in FIG. 3. The flush ring is preferably molded plastic tubing and has a plurality of spaced-apart outlets 68 on the underside of the tubing which will serve to direct water downwardly along the interior walls of the bowl. The flush ring may be fabricated as an integral part of the bowl. The inlet 70 to the flush ring extends through an aperture 72 in the rear of the bowl and a suitable seal is provided around the inlet to prevent leakage from the bowl at this point. A filtering screen 75, which may be plastic or wire mesh, is seated in the lower interior portion of the bowl. A suitable deodorizer cake 76 may be placed on the screen 75.

The flush ring is connected to the water line 16 by means of a tee 80 interposed in the filler line 18. One outlet of the tee connects to water line 82 which is flexible tubing. Water line 82 extends upwardly adjacent the rear and side of the toilet tank 14. The upper end of the tubing 82 is connected to a flush valve 84 via conventional fitting 86. The flush valve 84 has a handle 88 which when operated will allow water to flow to the flush ring to be discharged downwardly along the interior surface of the bowl. The outlet of the flush valve is connected by means of an elbow 90 and fitting 92 to the inlet 70 of the flush ring. The flush valve 84 is shown as manually operable but may also be automatic which either periodically flushes or flushes when it is used by infra red or other conventional sensing devices.

The bowl 50 is mounted on the upper end of a flexible support 108 which, in turn, is attached to the toilet at a pivotal support 110 at its lower end. The pivot support includes a fixed bracket 90 secured to the toilet at bore 32 provided in the toilet bowl. The bracket 90 extends rearwardly along the tank and a pivot arm 102 is pivotally secured to the bracket 90 by means of pivot pin 104. The fixed bracket 90 and the pivot arm 102 comprise a pivot assembly which, as will be explained hereafter, permits the bowl to be pivoted forwardly to a use-position and pivoted rearwardly to the stored position shown in FIG. 1 when not in use. The stored position shown in FIG. 1 places the bowl conveniently out of the way so it will not interfere with the normal use, maintenance and cleaning of the toilet.

The vertical flexible support 108 allows the bowl to be pulled forwardly and lowered to the appropriate elevation convenient for use. The vertical flexible support in conjunction with the pivotal support 110 provides a wide range of positions for the comfort and convenience of users.

The flexible vertical support 108 includes vertical spring 115 which has a cup-shaped connector 116 at its bottom end. A threaded bolt 118 depends from the connector 116 so that the connector and attached spring 115 may be secured to the outer end of the pivot arm 102 by means of nut 119. A fitting 120 is provided in the side of the connector 116 to facilitate connection of the lower drain line section 130 of the drain line. The upper end of spring 115 is secured about the neck of the outlet 56 of the bowl at clamp 128. Drainage of the bowl is accommodated by upper drain line section 132 which has its upper end clamped or otherwise secured to the distal end of the outlet 56 of the bowl at 129. Drain line 132 is a flexible tubing member and extends downwardly enclosed within the interior of the spring 115 to the coupling 116 where it is attached to a fitting 120. The remaining section 130 of the drain line is connected to fitting 120. The lower drain line section 130 extends beneath the toilet seat lid 30 at the rear of the toilet.

Figure 4A:
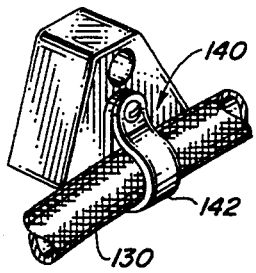
FIG. 4A shows a hose clamp that retains the waste line in place.
Figures 4, 5, 6, 7, 8, 9:
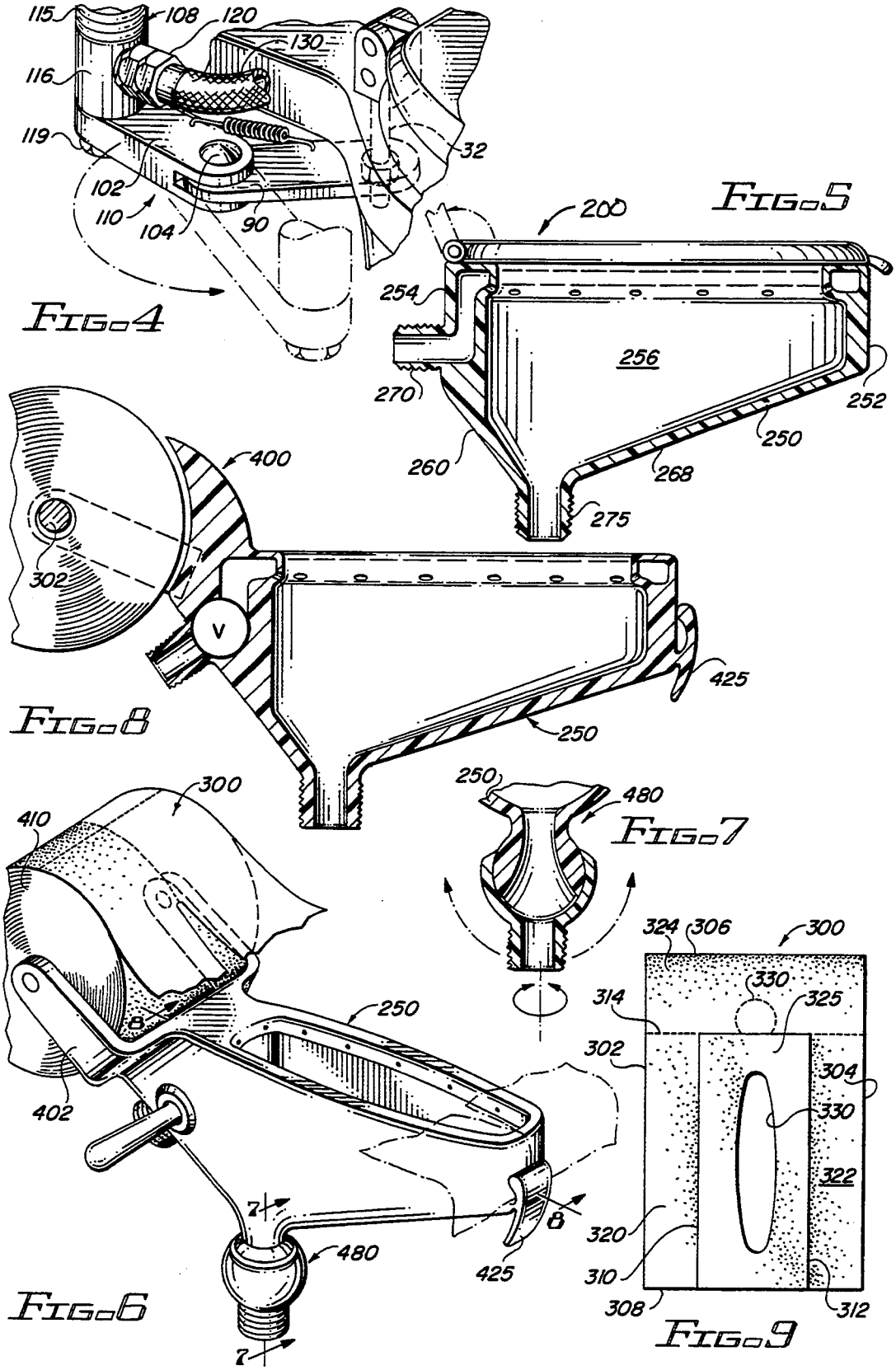
FIG. 4 is a detail view showing the lower end of the support attached to a toilet bowl.
FIG. 5 is a cross sectional view showing another embodiment in which the bowl is elongated for use by men and women.
FIG. 6 is a perspective view of another embodiment in which a sanitary paper dispenser is attached to the bowl.
FIG. 7 is a sectional view taken along line 7—7 of FIG. 6.
FIG. 8 is a sectional view taken along line 8—8 of FIG. 6.
FIG. 9 is a plan view of a section of a sanitary cover.

As seen in FIG. 4 and 4A, a clamp 140 which is generally U-shaped may be positioned on the horizontal surface of the toilet beneath the seat and serves to hold the drain tubing in place at loop 142. The lower section of drain line 130 extends along the rear of the toilet bowl 12 and upwardly over the interior dam 135 in the toilet terminating at the sewer 26. Preferably the distal end of the drain line section 130 is slightly bent inwardly so that it will better resist, it being unintentionally pulled or dislodged from the waste line 26. The lower drain section 136 is flexible and follows the interior configuration of the toilet forming an inverted U-section 140 which creates a water seal to prevent noxious gases and odors from escaping upwardly through the drain line.

When installed, the urinal is in the normal non-use position shown in FIG. 1 which places it out of tile way but convenient for use. In use, the user will grasp the urinal bowl 50 on the flexible support and pull tile device forward causing the urinal bowl 50 to be moved forward or laterally and also lowered to the desired position. This movement is due to the flexibility of the support 100 and the forward pivotal movement of arm 102.

The urinal is flushed after each use by means of flush valve 84 which is actuated by operating tile lever 88. A small quantity of water, typically a pint or so, is discharged through tile spaced-apart holes 68 in the flush ring 60 which water flows down along tile interior sides of the urinal. The waste along with the water passes across the deodorizer 76 and screen 75 to the upper and lower drain lines and is ultimately discharged into tile sewer 26. Odors are prevented from flowing from the waste line through the drain line by the water seal that is maintained in the lower section 130 of the drain line as it passes across the trap 22. After use, release of the bowl will allow the urinal to return to its normal out-of-the-way position adjacent the toilet tank at the rear of the toilet. An important aspect of the invention is that the urinal does not require that the toilet tank 15 be flushed, but rather only a small quantity of rinse water from flush valve 86 is required. Thus, in contrast to normal toilet operation, a very small amount of water is utilized. It is estimated that between about 1½ to 5 gallons of water per flush are saved, using the urinal of the present invention.

The device will mount to either side of the toilet bowl at the preference of the user. The device is flexible and adjustable to accommodate users of all ages and physical sizes. The construction, being mostly plastic, is durable, rust-resistant and inexpensive either as an OEM product or as an aftermarket modification.

Other significant benefits result from the invention. Use of the urinal will help to avoid the male "seat-down" controversy and will accordingly maintain the toilet seat in a dry, condition. Soiling of carpet, flooring and clothing is less likely than when using the toilet for urination. Embarrassing noise is also reduced.

The urinal shown in FIGS. 1 to 4, is designed primarily for use by men. FIG. 5 shows an alternate embodiment of the present invention in which the urinal may be used by either men or women, although the design is primarily adapted to accommodate use by women.

The embodiment shown in FIG. 5 is generally designated by the numeral 200. The device is again attachable to a conventional toilet having a toilet bowl 12 and tank 14. The construction of the device with the exception of the bowl 250 is as has been described above. Accordingly, detailed description of the other elements described above is not believed necessary. It is sufficient to say the device is connected in the same manner as shown in FIG. 4 to water line 16 by means of flexible tubing 82 across manual or automatic flush valve 88. A vertical, flexible support 108 maintains the bowl 250 adjacent the toilet. The vertical support 108 is attached to the toilet at its lower end to a pivot assembly 110. Drain line 130 connects to the bowl 250 and extends within the toilet bowl to the sewer line 26.

The bowl 250 is adapted for use by either men or women. The bowl is shown having a front vertical wall 252, rear wall 254 and opposite side walls 256. Rear wall 254 is deeper than the front wall 252. A bottom section 260 extends downwardly and forwardly to an intermediate location and from there bottom wall 268 slopes upwardly intercepting the lower edge of front wall 252. As viewed from the top, the bowl has a generally rectangular configuration having a width of approximately 2" to 3" and an overall length of 6" to 14". The depth of the front wall is approximately 1" to 2" and the depth of the rear wall 254 is approximately 3" to 4". Again, the bowl 250 may be molded of a plastic material of suitable strength and chemical resistance.

The flexible water line 82 connects to the rear wall 254 at fitting 270. A discharge pipe or outlet 275 depends from the bowl.

In some instances, it may be desirable, particularly when used by women, to provide a sanitary cover on the urinal. Accordingly, referring to FIG. 9, a sanitary cover is fabricated of paper which preferably is treated to have some frictional characteristics so the cover will properly adhere to the bowl in use. The cover is designated by the numeral 300 and is adapted for use with the type of bowl designated 250 as shown in FIG. 5. The paper cover 300 has a top section which is generally rectangular having opposite edges 302 and 304, front edge 306 and rear edge 308. Fold lines 310 and 312 extend from the rear edge and intercept transverse fold line 314. Sections 320 and 322 are attached to the center section 325 along fold lines defined at edges 302 and 304. A front flap or skirt 324 is formed at the front and is provided with a pull tab for user convenience. Center section 325 is provided with a longitudinal aperture 330. In use, the sanitary cover will rest on the bowl extending across the opening with the aperture 330 above the bowl. The skirts or flaps 320, 322 will depend or hang at the opposite sides of the bowl and skirt 324 depends across the front 306.

The sanitary covers may be provided in roll form and separable at transversely extending perforations or can be provided in individual packages which would be preferably provided at the tab 330 such as on the upper surface of the toilet tank adjacent the urinal. When use of the urinal is completed, the user would simply grasp the cover at a convenient location such as at one of the sides and deposit the used sanitary cover in a convenient waste container or in the toilet.

FIGS. 6 to 8 show a modified form of the urinal of FIG. 3 having an attached dispenser 400 secured to the bowl 250. The dispenser has a roller 302 secured to the bowl by rearwardly extending bracket arms 402 for holding a roll 410 of covers 300 of the type shown in FIG. 4. The covers are separable and may be severed from the roll and placed over the bowl and temporarily held in place by a clip 425 at the front of bowl 250

A coupling 480 as seen in FIGS. 6 and 7 may be provided to allow both rotative and pivotal movement of the bowl 250 with respect to the flexible support 100. The remaining structure of the device is has been described above as is the operation. The principal advantage of the embodiment shown in FIGS. 6 and 7 is that the coupling or universal joint 480 has both pivotal and rotative movement of the bowl to further facilitate use by both men and women. The vertical, flexible support along with the pivotal support facilitates further positioning of the bowl. The elongated shape of the bowl accommodates use by men as well as by women when standing. While the bowl of the urinal has been shown as having a rectangular configuration, it could similarly be fondled in an elongated oval shape.

While the urinal of the present invention has been described as an after market attachment or accessory which can be easily adapted to toilets of most conventional designs. The urinal may also be used as a fixture independent of a toilet. In this case, the device would be constructed as shown in FIGS. 1 or 2 with the fixed bracket 90 secured to a suitable location such as the wall of a men's or women's rest room. The lower waste tubing line would be directly connected to a sewer line plumbed to the wall preferably through a suitable trap to prevent odors from the sewer emanating into the rest room area.

Thus, it will be seen from the foregoing, that the present invention provides a unique, new and novel low water volume urinal. The device is easy and convenient to use and may be mounted at either side of conventional toilets. The pivot arm and support structure make the device easily flexible and adjustable to the physical requirements of the user. The device is provided with a flush valve which may be manually operated or may be an automated flush valve. When used with a conventional toilet, the waste tubing connects directly to the drain making it unnecessary to waste large volumes of water in the conventional flushing process as a low volume of water will adequately flush the bowl. The device can be made from various materials but is preferably manufactured with the primary components such as the urinal, brackets, tubing and fittings being fabricated from plastic. The device is also easy to install.

The device provides the user benefits in addition to convenience and conservation. Wet toilet seats are avoided and carpet and clothes are less apt to become soiled.

It is understood that the present embodiments described above are to be considered as illustrative and not restrictive. It will be obvious to those skilled in the art to make various changes, alterations and modifications to the invention described herein. To the extent that these variations, modifications and alterations do not depart from the scope and spirit of the appended claims, they are intended to be encompassed therein.

We claim:

1. A urinal for attachment to a toilet of the type having a toilet bowl having an upper peripheral edge which defines an inlet opening and an outlet opening at a bottom edge, said outlet opening communicating with a sewer line through a trap and said toilet including a tank fluidly connected to said bowl and communicating with a water supply for selectively flushing said bowl, said urinal comprising:

(a) a urinal bowl having an interior and a discharge opening located at the bottom thereof;

(b) a first support member attachable to a fixture and being pivotal;

(c) a second support member having a first end connected to the urinal bowl and a second end connected to said first support, said second support being flexible between said first and second ends to flex between a stored position with the urinal bowl adjacent the tank and a use position forward of the tank, said second support member adapted to permit manual positioning of the location and height of the urinal bowl in said use position;

(d) a flexible waste line having a first end fluidically connected with the discharge opening of the urinal bowl and having a length adapted to extend from the discharge opening of the urinal bowl over said peripheral edge, through the outlet opening of the toilet bowl through said trap and into the sewer line to an opposite second end of said waste line; and (e) a flexible water line adapted to be connected to said water supply and communicating with the interior of said urinal bowl for flushing the urinal bowl, whereby the urinal bowl may be manually moved from the stored position adjacent the toilet tank by pivoting said first support member and moving said second support member to position said urinal bowl at a selected height and location in said use position whereby discharged waste will flow from the interior of the urinal bowl via the waste line to the sewer line by-passing the toilet bowl thereby eliminating flushing of the toilet and odors.

2. The urinal of claim 1 further including a flush ring connected to said water flexible line and extending around the interior of said urinal bowl.

3. The urinal of claim 1 wherein said urinal bowl includes a filter screen extending across the urinal bowl above the discharge opening.

4. The urinal of claim 1 wherein said urinal includes a cover for covering and uncovering the urinal bowl.

5. The urinal of claim 1 wherein said urinal bowl is fabricated from plastic.

6. The urinal of claim 5 wherein said urinal bowl is generally funnel shaped.

7. The urinal of claim 1 wherein said urinal bowl has a generally narrow, elongate shape and wherein said urinal bowl is connected to said second support member at a universal joint.

8. The urinal of claim 1 wherein said second support member comprises a spring and wherein said flexible waste line extends at least partially through the interior of said spring.

9. The urinal of claim 1 wherein said first support member comprises a fixed bracket adapted to be secured to the toilet and further including a pivot arm pivotally attached to said bracket at one end and secured to said second support member at the other end.

10. The urinal of claim 1 further including at least one sanitary, cover configured to extend over said urinal and wherein the urinal bowl includes clip means for temporarily securing said cover to said urinal bowl.

11. The urinal of claim 10 wherein said urinal includes dispenser means for selectively dispensing said at least one sanitary cover.

* * * * *